US009380653B1

(12) United States Patent
Stepps et al.

(10) Patent No.: US 9,380,653 B1
(45) Date of Patent: Jun. 28, 2016

(54) DRIVER ASSEMBLY FOR SOLID STATE LIGHTING

(71) Applicants: Dale Stepps, Plantation, FL (US); Jose Suarez, Pembroke Pines, FL (US)

(72) Inventors: Dale Stepps, Plantation, FL (US); Jose Suarez, Pembroke Pines, FL (US)

( * ) Notice: Subject to any disclaimer, the term of this patent is extended or adjusted under 35 U.S.C. 154(b) by 37 days.

(21) Appl. No.: 14/529,365

(22) Filed: Oct. 31, 2014

(51) Int. Cl.
*H01K 1/62* (2006.01)
*H05B 33/08* (2006.01)

(52) U.S. Cl.
CPC ..... *H05B 33/0803* (2013.01)

(58) Field of Classification Search
USPC ..... 315/32, 33, 51
See application file for complete search history.

(56) References Cited

U.S. PATENT DOCUMENTS

| | | | |
|---|---|---|---|
| D60,004 | S | 12/1921 | Adam |
| D78,750 | S | 6/1929 | Gunnison |
| D129,357 | S | 9/1941 | Greppin |
| D132,276 | S | 5/1942 | Greppin |
| D143,336 | S | 12/1945 | Morrison |
| D150,357 | S | 7/1948 | Herbster |
| D155,680 | S | 10/1949 | Baker |
| D164,606 | S | 9/1951 | Schlage |
| D234,797 | S | 4/1975 | De John et al. |
| 4,369,490 | A | 1/1983 | Blum |
| 4,396,882 | A | 8/1983 | Kellenbenz |
| 4,471,268 | A | 9/1984 | Brown et al. |
| D303,437 | S | 9/1989 | Mason |
| 4,910,654 | A | 3/1990 | Forge |
| D339,651 | S | 9/1993 | Vieyra |
| D365,159 | S | 12/1995 | Tinen |
| 5,604,411 | A | 2/1997 | Venkitasubrahmanian et al. |
| 5,652,504 | A | 7/1997 | Bangerter |
| D385,897 | S | 11/1997 | Lin |
| 5,738,436 | A | 4/1998 | Cummings et al. |
| D397,482 | S | 8/1998 | Binsukor |
| D405,216 | S | 2/1999 | Porter et al. |
| D413,137 | S | 8/1999 | Lin |
| 5,953,221 | A | 9/1999 | Kuhn et al. |

(Continued)

FOREIGN PATENT DOCUMENTS

| | | |
|---|---|---|
| WO | WO 2009/064433 | 5/2009 |
| WO | WO 2009/064434 | 5/2009 |

*Primary Examiner* — Douglas W Owens
*Assistant Examiner* — Jiani Chen
(74) *Attorney, Agent, or Firm* — Malloy & Malloy, P.L.

(57) ABSTRACT

A driver assembly for solid state lighting that includes at least one LED which includes a base element having an upper surface, a lower surface, an outer peripheral edge extending about a periphery thereof and a perimeter region defined adjacent to the outer peripheral edge. A plurality of operative components are secured to the base element and are collectively operative at least 40 watts in order control current flow to the LED. The plurality of operative components include primary heat generating components and heat sensitive components, with the primary heat generating components disposed on the perimeter region of the base element and the heat sensitive component disposed in spaced relation from the peripheral region at which the primary heat generating components are disposed. The primary heat generating components are disposed in a vertical orientation wherein a vertical surface that extends away from the base element has a greater surface area than a horizontal surface that confronts the base element. Further provided is a heat sink which has a pair of vertical elements formed of a thermally conductive material, the vertical elements extending upward along part of the outer peripheral edge of the base element in confronting, heat receiving relation to the vertical surfaces of the primary heat generating components.

23 Claims, 5 Drawing Sheets

(56) References Cited

U.S. PATENT DOCUMENTS

| | | | |
|---|---|---|---|
| 6,013,988 | A | 1/2000 | Bucks et al. |
| 6,016,038 | A | 1/2000 | Mueller et al. |
| 6,094,014 | A | 7/2000 | Bucks et al. |
| 6,147,458 | A | 11/2000 | Bucks et al. |
| 6,160,359 | A | 12/2000 | Fleischmann |
| 6,188,177 | B1 | 2/2001 | Adamson et al. |
| 6,211,626 | B1 | 4/2001 | Lys et al. |
| 6,234,645 | B1 | 5/2001 | Borner et al. |
| 6,234,648 | B1 | 5/2001 | Borner et al. |
| 6,250,774 | B1 | 6/2001 | Begemann et al. |
| 6,304,464 | B1 | 10/2001 | Jacobs et al. |
| 6,375,338 | B1 | 4/2002 | Cummins et al. |
| 6,388,388 | B1 | 5/2002 | Weindorf et al. |
| 6,472,828 | B1 | 10/2002 | Pruett et al. |
| D469,211 | S | 1/2003 | Homann |
| 6,561,690 | B2 | 5/2003 | Balestriero et al. |
| 6,577,512 | B2 | 6/2003 | Tripathi et al. |
| 6,586,890 | B2 | 7/2003 | Min et al. |
| 6,608,617 | B2 | 8/2003 | Hoffknecht et al. |
| 6,617,795 | B2 | 9/2003 | Bruning |
| 6,642,674 | B2 | 11/2003 | Liao et al. |
| 6,692,136 | B2 | 2/2004 | Marshall et al. |
| D490,182 | S | 5/2004 | Benensohn |
| 6,744,223 | B2 | 6/2004 | Laflamme et al. |
| D493,188 | S | 7/2004 | Brueck |
| 6,788,011 | B2 | 9/2004 | Mueller et al. |
| 6,827,470 | B2 | 12/2004 | Sagal et al. |
| 6,856,890 | B2 | 2/2005 | Muto et al. |
| 6,917,482 | B2 | 7/2005 | Minamino et al. |
| 6,922,022 | B2 | 7/2005 | Bucks et al. |
| D509,016 | S | 8/2005 | Benghozi |
| 6,972,525 | B2 | 12/2005 | Bucks et al. |
| 6,975,079 | B2 | 12/2005 | Lys et al. |
| 7,038,399 | B2 | 5/2006 | Lys et al. |
| 7,129,933 | B1 | 10/2006 | Nishikawa et al. |
| 7,183,727 | B2 | 2/2007 | Ferguson et al. |
| 7,186,000 | B2 | 3/2007 | Lebens et al. |
| 7,202,608 | B2 | 4/2007 | Robinson et al. |
| 7,233,115 | B2 | 6/2007 | Lys |
| 7,252,385 | B2 | 8/2007 | Engle et al. |
| 7,256,554 | B2 | 8/2007 | Lys |
| 7,262,559 | B2 | 8/2007 | Tripathi et al. |
| D550,391 | S | 9/2007 | Cesaro |
| D554,974 | S | 11/2007 | Huang |
| D556,075 | S | 11/2007 | Teiber et al. |
| 7,300,173 | B2 | 11/2007 | Catalano et al. |
| 7,312,582 | B2 | 12/2007 | Newman, Jr. et al. |
| 7,329,024 | B2 | 2/2008 | Lynch et al. |
| 7,348,736 | B2 | 3/2008 | Piepgras et al. |
| 7,352,138 | B2 | 4/2008 | Lys et al. |
| 7,358,681 | B2 | 4/2008 | Robinson et al. |
| 7,358,706 | B2 | 4/2008 | Lys |
| 7,377,683 | B2 | 5/2008 | Koegler et al. |
| 7,394,212 | B2 | 7/2008 | Wey et al. |
| 7,420,335 | B2 | 9/2008 | Robinson et al. |
| 7,459,864 | B2 | 12/2008 | Lys |
| D591,448 | S | 4/2009 | Huang |
| 7,522,615 | B2 | 4/2009 | Binder |
| D592,347 | S | 5/2009 | Trott et al. |
| D592,348 | S | 5/2009 | Trott et al. |
| 7,556,404 | B2 | 7/2009 | Nawashiro et al. |
| 7,557,521 | B2 | 7/2009 | Lys |
| 7,587,289 | B1 | 9/2009 | Sivertsen |
| D602,193 | S | 10/2009 | Soderman et al. |
| D602,195 | S | 10/2009 | Soderman et al. |
| 7,602,158 | B1 | 10/2009 | Iacob |
| D604,008 | S | 11/2009 | Soderman et al. |
| 7,722,227 | B2 | 5/2010 | Zhang et al. |
| 7,737,643 | B2 | 6/2010 | Lys |
| 7,738,270 | B2 | 6/2010 | Chang |
| 7,760,107 | B1 | 7/2010 | Stepps et al. |
| 7,802,902 | B2 | 9/2010 | Moss et al. |
| 7,810,960 | B1 | 10/2010 | Soderman |
| 7,878,692 | B2 | 2/2011 | Soderman |
| 7,980,736 | B2 | 7/2011 | Soderman et al. |
| 8,011,794 | B1 | 9/2011 | Sivertsen |
| 8,029,158 | B2 | 10/2011 | Chen |
| 8,098,021 | B2 | 1/2012 | Wang et al. |
| 8,154,221 | B2 | 4/2012 | Godbole et al. |
| 8,159,198 | B2 | 4/2012 | Dishman et al. |
| 8,226,272 | B2 | 7/2012 | Chen |
| 8,237,381 | B2 | 8/2012 | Harbers et al. |
| 8,258,706 | B2 | 9/2012 | Maruyama et al. |
| 8,344,639 | B1 | 1/2013 | Bahrehmand |
| 8,348,470 | B2 | 1/2013 | Liu et al. |
| 8,360,614 | B1 | 1/2013 | Soderman et al. |
| 8,368,310 | B1 | 2/2013 | Roosli |
| 8,398,253 | B2 | 3/2013 | Sivertsen |
| 8,531,226 | B2 | 9/2013 | Montalbo et al. |
| 8,534,873 | B1 | 9/2013 | Soderman et al. |
| 8,573,812 | B2 | 11/2013 | Joung et al. |
| 8,643,300 | B1 | 2/2014 | Stepps et al. |
| 8,674,544 | B2 | 3/2014 | Rada et al. |
| 8,714,797 | B2 | 5/2014 | Hwu |
| 8,797,766 | B2 | 8/2014 | Delpapa et al. |
| 8,957,610 | B2 | 2/2015 | Lee |
| 9,014,829 | B2 | 4/2015 | Chemel et al. |
| 9,054,584 | B2 | 6/2015 | Haight et al. |
| 2003/0072160 | A1 | 4/2003 | Kuepper et al. |
| 2003/0102845 | A1 | 6/2003 | Aker et al. |
| 2004/0135523 | A1 | 7/2004 | Takahashi |
| 2005/0213047 | A1 | 9/2005 | Slobodin et al. |
| 2006/0126328 | A1 | 6/2006 | Coushaine |
| 2007/0114010 | A1 | 5/2007 | Upadhya et al. |
| 2007/0139923 | A1 | 6/2007 | Negley et al. |
| 2007/0223230 | A1 | 9/2007 | Trojanowski et al. |
| 2007/0242461 | A1 | 10/2007 | Reisenauer et al. |
| 2007/0279821 | A1 | 12/2007 | Sells |
| 2008/0007944 | A1 | 1/2008 | Cerfuerth et al. |
| 2009/0109052 | A1 | 4/2009 | Stepps et al. |
| 2009/0122553 | A1 | 5/2009 | Soderman et al. |
| 2009/0195168 | A1 | 8/2009 | Greenfeld |
| 2009/0278479 | A1 | 11/2009 | Platner et al. |
| 2009/0303602 | A1 | 12/2009 | Bright et al. |
| 2010/0134038 | A1 | 6/2010 | Shackle et al. |
| 2010/0134047 | A1 | 6/2010 | Hasnain |
| 2010/0271178 | A1 | 10/2010 | Ahmad |
| 2010/0314641 | A1 | 12/2010 | Schmidt |
| 2011/0012530 | A1 | 1/2011 | Zheng et al. |
| 2011/0026251 | A1 | 2/2011 | Liu et al. |
| 2011/0095703 | A1 | 4/2011 | Wilson et al. |
| 2011/0285298 | A1 | 11/2011 | Schwalenberg et al. |
| 2011/0317423 | A1 | 12/2011 | Chen |
| 2012/0092870 | A1 | 4/2012 | Tralli et al. |
| 2012/0146505 | A1 | 6/2012 | Jonsson |
| 2013/0043833 | A1 | 2/2013 | Katz et al. |
| 2013/0257302 | A1 | 10/2013 | Canter et al. |
| 2013/0271001 | A1 | 10/2013 | Kurachi et al. |
| 2014/0301062 | A1 | 10/2014 | David et al. |

25
28
36
34
26
22
29
25'
38
50
26'
28
52

25'

26
20
24
25
40
42
20'

DRIVER ASSEMBLY FOR SOLID STATE LIGHTING

BACKGROUND OF THE INVENTION

1. Field of the Invention

The present invention relates to a driver assembly for solid state lighting wherein the driver assembly is substantially compact and efficient so as to achieve a variety of uses, can achieve a varied range of power outputs without overheating, and is sufficiently contained so as to be usable in a setting wherein an explosion proof fixture is necessary.

2. Description of the Related Art

Solid state lighting, and in particular the powering and use of LEDs for lighting is becoming increasingly popular as a highly efficient and energy conscious form of illumination that can be used in a number of different applications to replace traditional incandescent or fluorescent lighting. A significant problem associated with the use of solid-state lighting, however, relates to complications that arise in connection with the driver that is utilized to power the LED light. Specifically, because LED lights operate at lower voltages than are traditionally supplied in most operative environments, a driver is necessary to properly manage the load and effectively supply the needed low voltage power to the LED. As part of this power management and control process, however, the drivers are particularly susceptible to overheating given the nature of the components and the manner in which they are being utilized.

Further, overheating does not merely cause a problem within the context of generating unwanted heat into an environment, but is especially problematic in sold state lighting as it can lead to failures in one or more components of the driver, and thus a malfunction or shut down of the entire system. For this reason, most typical solid state drivers include some form of heat sink to draw heat away from the driver. Unfortunately, however, inefficiencies in the configuration and design of the operative circuitry of traditional drivers and heat sinks still result in greater than optimal levels of failure, and require that the drivers and heat sinks be substantially large so as to effectively manage the heat by providing a large surface area from which the heat can be dissipated. This is especially the case at larger power outputs such as those that might be necessary for room lighting, and even more significantly for the lighting of large spaces. As a result, LED based solid state lighting has seen limited applicability where a substantial amount of light is needed. Further, when attempts have been made to provide greater illumination using LEDs, illumination systems with large driver bars and heat sinks must typically be employed so as to provide a large surface area for heat dissipation, thus requiring a large mounting surface and a larger footprint than may be optimal.

A further significant limitation associated with the field of solid-state lighting relates to the inapplicability of cost effective solid-state lighting in a variety of environments and in particular environments wherein all lighting and fixtures must be explosion proof. Specifically, in certain environments where flammable gases and other materials may be present, all devices and systems present in the area are required to be explosion proof. This means that all components must be properly insulated so that no external sparks or explosions can affect the area and possibly ignite the flammable conditions that could exist in the environment. Because of the nature of traditional solid-state driver assemblies, there is always some risk of uncontainable sparks or explosions at the driver, and the large size of traditional driver assemblies makes it impractical to properly address this risk.

Another factor that often leads to the requirement that a solid-state driver have a substantially large size, thereby making it impractical for a variety of applications, relates to the risk of magnetic interference and more particularly cross coupling between components such as the input and output inductors. Specifically, magnetic cross coupling results in a state wherein even when the power to the output inductor is intended to be turned off, cross coupling to the powered input inductor will still result in power at the output inductor. As a result, traditional solid-state driver assemblies require that the input and the output inductors be placed in substantially spaced apart relation from one another. Of course, because of the already present requirement for a large surface area in order to effectively dissipate heat, the large spacing necessary is often available to allow for this effective separation, and no alternate solution has been contemplated. As a result, this provides yet another reason to require larger sized driver assemblies that in turn limit the applicability of the solid-state lighting to environments that can accommodate a larger fixture and driver assembly, and that can accommodate the larger material and installation costs associated with larger footprint driver assemblies.

Still another drawback associated with traditional solid-state driver assemblies relates to the ever increasing need for power output customization. Specifically, as more and more applications for LED lighting are designed and developed, a variety of different, but often very precise power outputs are required. For example, a particular lighting application may require a very precise output wattage be maintained in order to achieve proper compliance of a fixture or device in which the LED light source is utilized. Accordingly, modification and reconfiguration of the driver assembly to achieve this desired customized power output, and pre-programming of components, is often required. This need for customization, however, further limits the applicability of traditional driver assemblies and increases the costs associated with their use. For example, manufacturers of the driver assemblies are not in a position to manufacture large volumes of different configuration driver assemblies to maintain an effective stock. Rather, they typically keep smaller fully fabricated inventories and instead maintain separate components that cannot be finally assembled until they receive an order and are aware of the precise required specifications. Further, this limitation not only increases the costs associated with the manufacture of the drivers and the maintaining of uncompleted inventory, but also limits the effective applicability of the driver assemblies as the drivers cannot be pre-prepared for certain environments, such as an environment that requires an explosion proof driver assembly or a weather resistant driver assembly.

Accordingly, there is a substantial need in the art for a compact and highly efficient solid-state driver assembly which is able to achieve a substantially small and compact operative footprint, while still allowing for effective heat dissipation in order to minimize the potential for failure or malfunction of the driver assembly. Also, there is a substantial need in the art for a compact and efficient driver assembly that can be utilized in a variety of applications, including applications wherein an explosion proof and/or weather or waterproof fixture is necessary, while still allowing for substantially customizability in terms of power output even after manufacturing and product assembly.

SUMMARY OF THE INVENTION

The present invention relates to a driver assembly for solid-state lighting that includes at least one LED. The driver assembly includes a base element that has an upper surface and a lower surface, as well as an outer peripheral edge extending about a periphery thereof. Defined on the base element is also a perimeter region. This perimeter region is adjacent to the outer peripheral edge and is operative for the positioning of operative components.

The driver assembly of the present invention further includes a plurality of operative components. These operative components are secured to the base and are collectively operative at least 40 watts. Moreover, these operative components are configured to effectively control the current flow to the at least one LED thereby effectuating the illumination by the LED.

Included as part of the plurality of operative components are at least two primary heat generating components and at least one heat sensitive component. These varied components are disposed on the base element, with the primary heat generating components preferably disposed on the perimeter region of the base element adjacent the outer edge. Conversely the at least one heat sensitive component is preferably disposed in spaced relation from the outer peripheral edge that is adjacent the peripheral region at which the primary heat generating components are disposed. In this manner, the heat sensitive components can achieve some isolation from the effects of the heat generated by the primary heat generating components during operation of the driver assembly.

In order to further facilitate optimal heat dissipation, and thereby minimize the negative impact of heat on the driver assembly as a whole, and in particular on the heat sensitive component(s), the primary heat generating components disposed at the perimeter region are further disposed in a vertical orientation. Specifically, in the vertical orientation a vertical surface of the component that extends away from the base element has a greater surface area than the horizontal surface that confronts the base element. This is unlike traditional component mounting configurations that provide for the utilization of flat mounted components, thus minimizing a height. Because the present invention provides for the vertical orientation of the heat generating components, it provides a larger vertical surface which will necessarily radiate a greater amount of heat than the smaller horizontal surface.

The driver assembly of the present invention further comprises a heat sink. Specifically, the heat sink is formed primarily of a thermally conductive material and preferably includes at least one vertical element, and in an illustrated embodiment a planar element. Preferably, the planar element is secured in confronting, heat receiving relation to the lower surface of the base element. The at least one vertical element extends upwardly from the planar element along at least a portion of the outer peripheral edge of the base element. Preferably it extends along the outer peripheral edge at the perimeter region wherein at least some of the primary heat generating components are disposed, and is thereby positioned in confronting, heat receiving relation to the vertical surface of the primary heat generating components. In this manner, heat that radiates or conducts from the vertical surface of the primary heat generating component is optimally directed into the vertical elements of the heat sink and away from the remaining operative components disposed on the base element.

It is an object of the present invention to provide a substantially compact and highly efficient driver assembly for solid-state lighting which can achieve a substantially compact footprint and thereby be functional in a variety of pre-existing environments wherein traditional incandescent or fluorescent lighting is being replaced, without requiring substantial modification or alteration of the existing construction or infrastructure.

It is a further object of the present invention to provide a driver assembly for solid-state lighting which can effectively dissipate heat in a substantially compact configuration so as to be able to be properly potted in order to define an explosion proof, weather proof, and/or fluid resistant lighting system.

It is still another object of the present invention to provide a substantially compact and highly efficient solid-state driver assembly which can maintain a substantially small and highly functional operative footprint without being susceptible to magnetic interference and/or cross coupling.

Yet another object of the present invention is to provide a solid-state driver assembly which can be highly adaptable to a variety of operative power settings without the need to interchange and/or directly reconfigure operative components.

It is an object of the present invention to provide a substantially compact and completely insulated solid-state driver assembly which can be pre-manufactured and effectively customized even after initial manufacture and installation.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
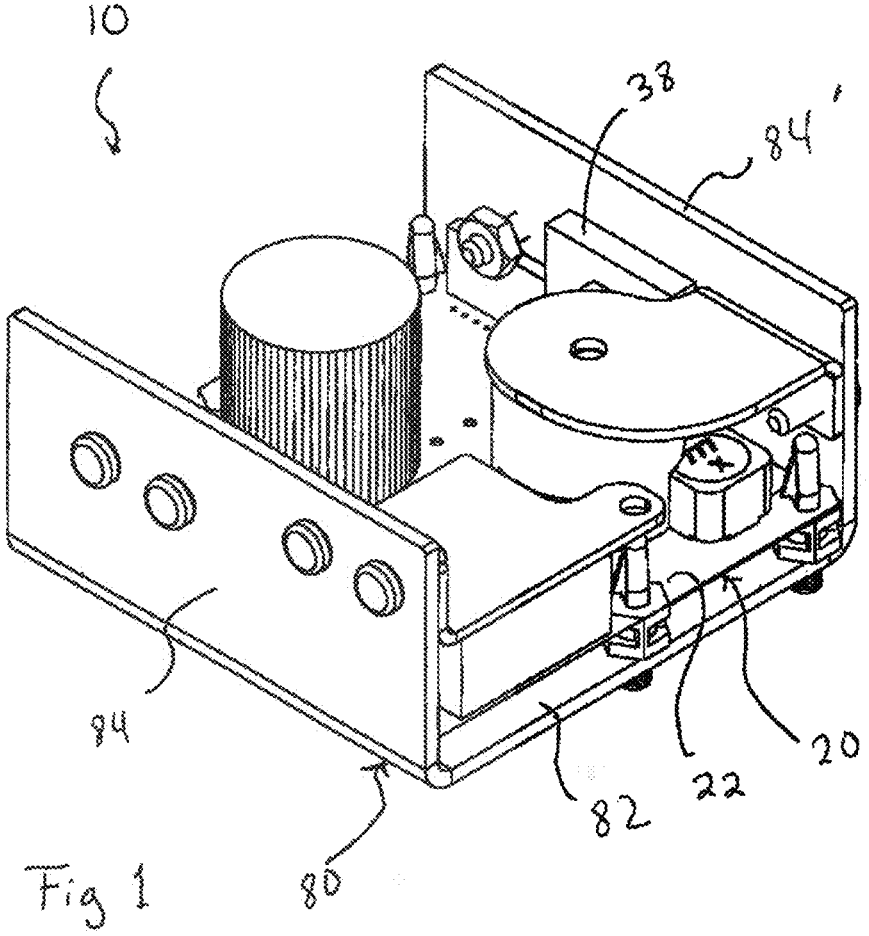
FIG. 1 is a perspective view of an embodiment of the driver assembly of the present invention.
Figure 2:
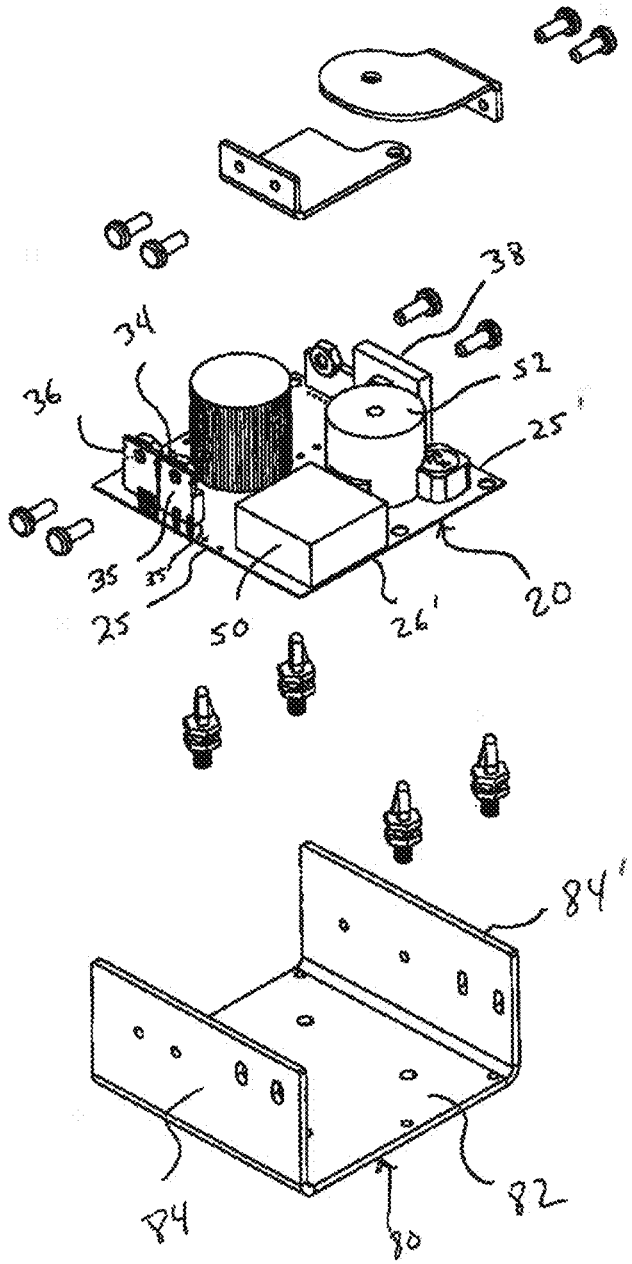
FIG. 2 is an exploded view of an embodiment of the driver assembly of the present invention.
Figure 3:
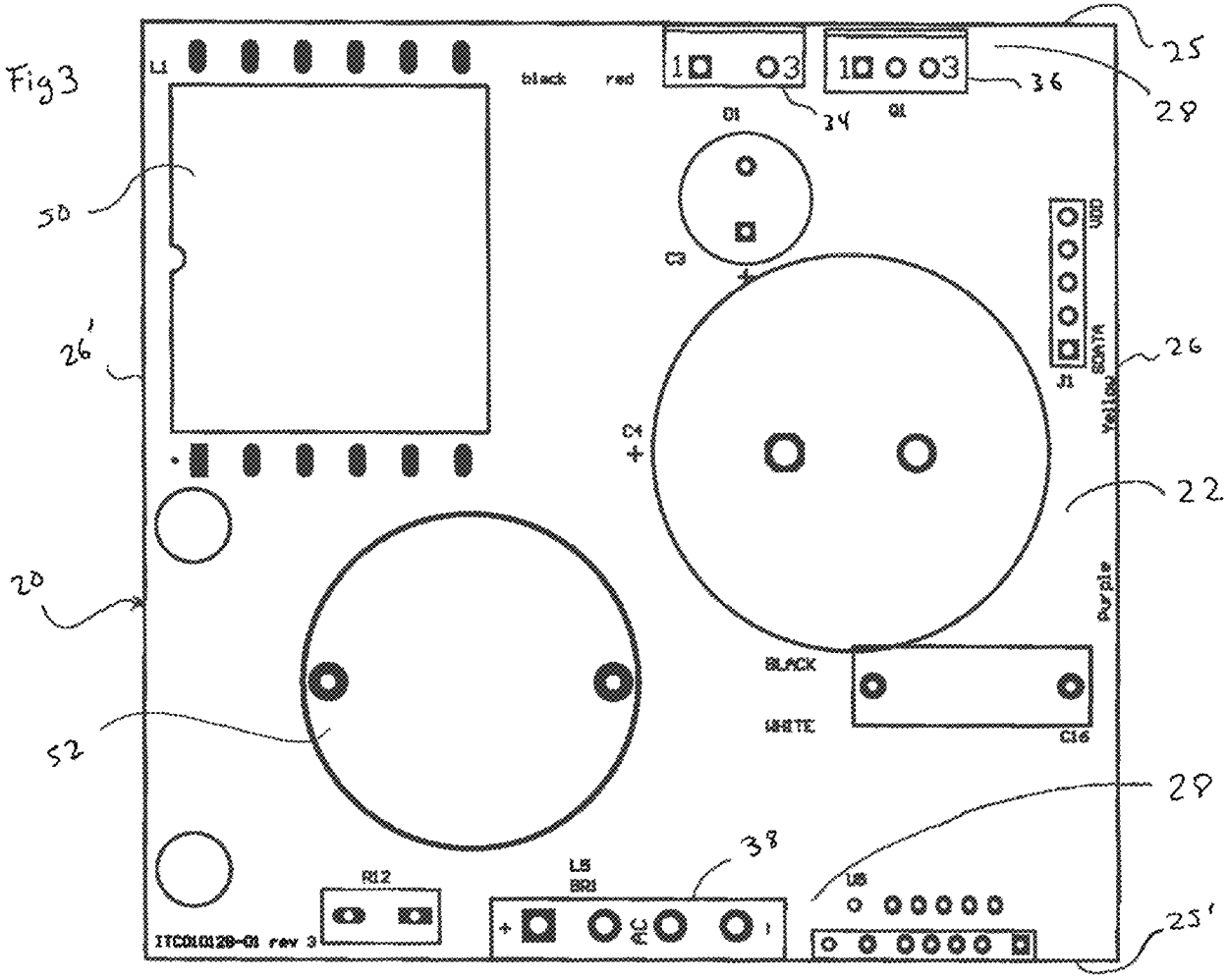
FIG. 3 is a top schematic representation of the base element and operative components disposed thereon.
Figure 4:
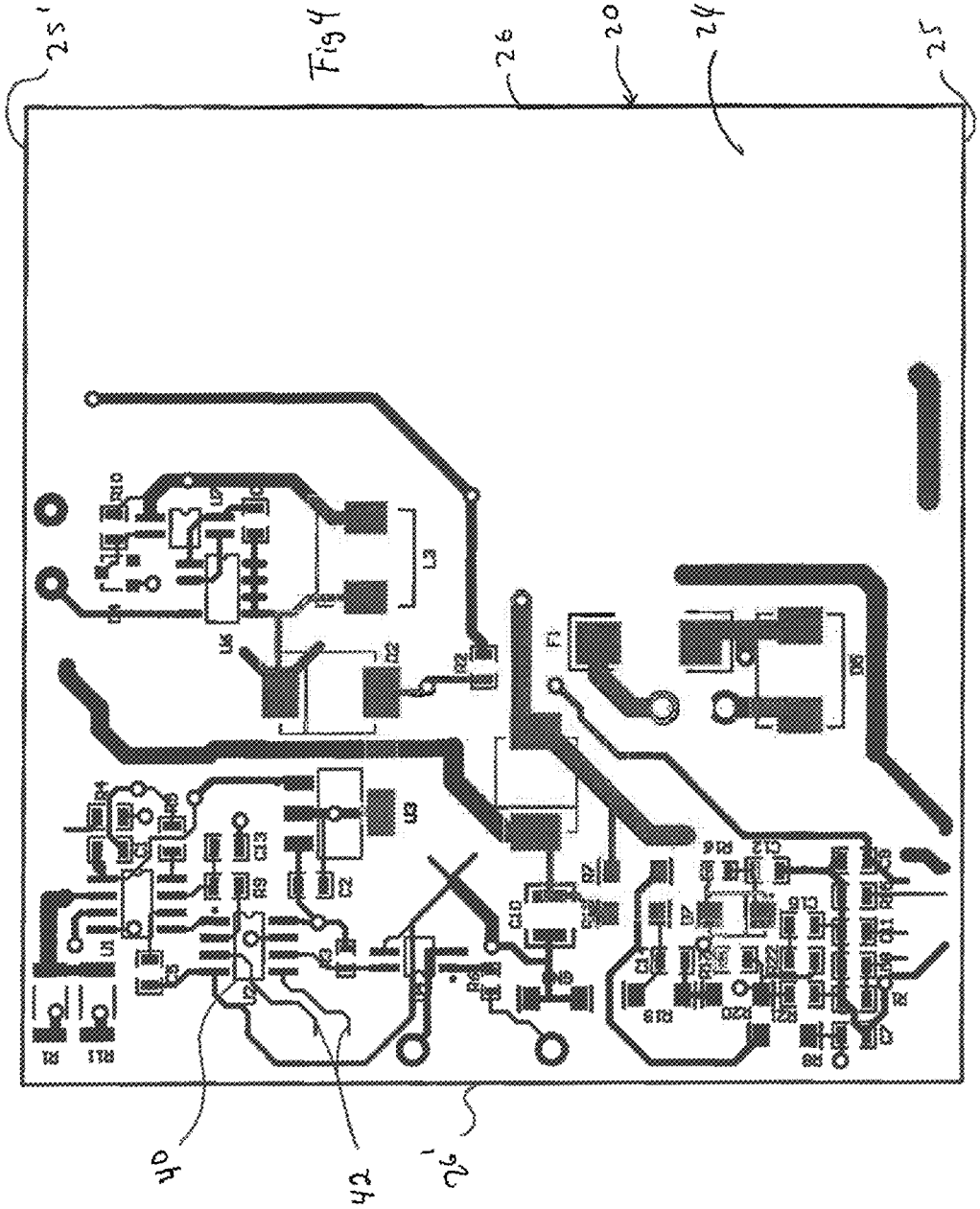
FIG. 4 is a bottom schematic representation of the base element and operative components disposed thereon.

The present invention is directed towards a driver assembly for solid-state lighting, generally indicated as 10. The driver assembly 10 is specifically configured to power at least one LED, but often will be utilized to power an array of LEDs in order to provide illumination for a particular desired application. In this regard, the driver assembly 10 of the present invention can be utilized for a variety of different lighting applications including indoor applications, outdoor applications, use within hazardous environments, and use in environments wherein the lighting assembly will be susceptible to adverse weather and/or liquids.

In a preferred embodiment of the present invention, the driver assembly 10 includes a base element, generally 20. The base element 20 is preferably constructed of a generally rigid material onto which a plurality of operative components can be secured. As such, it is preferred that the base element 20 comprise a printed circuit board (PCB). Although the base element 20 can take on any of a number of geometric configurations, in the illustrated embodiments it has a generally square configuration.

As viewed from the figures, the base element 20 preferably includes a substantially thin, wafer-like configuration with an upper surface 22 and a lower surface 24. Further, the base element 20 includes an outer peripheral edge extending about a periphery thereof. In the preferred embodiments wherein the base element includes a generally square or rectangular configuration, the outer peripheral edge of the base element 20 comprises two pairs of substantially parallel opposing edges 25, 25' and 26, 26'. Also, in the illustrated embodiment, one of said pair of substantially parallel opposing edges comprises hot edges 25, 25'. In this regard, the hot edges 25, 25' are defined as such not because they are inherently hot or at a higher temperature, but because, as will be described subsequently, they are adjacent to the location of some primary heat generating components. Further, it is preferred that at least one edge of the base element 20 be defined as a hot edge 25, although in the illustrated embodiments, based upon the number and positioning of the primary heat generating components, both opposing generally parallel edges are hot edges 25, 25'. Additionally, it is preferred that the second pair of opposing edges 26, 26' not be defined as hot edges within the scope of the present invention, as it is preferable that two intersecting edges not both act as hot edges as they will generally have a closer proximity to one another than the opposing parallel edges and the positioning of primary heat generating components as will be described, along intersecting edges may result in a less than optimal heat concentration. Nevertheless, it is still recognized and contemplated that more than one, and in some cases more than two of the outer peripheral edges can be defined as hot edges to meet the needs of the architecture of the operative components.

In the preferred illustrated embodiment of the present invention, it is also preferable that the outer peripheral edge of the base element 20 be less than 4 inches long in any directional axis. As such, in the context of a generally square base element 20 it is preferred that none of the opposing parallel edges 25, 25', 26, 26' be greater than approximately 4 inches long. As a result of this dimensional limit to the base element 20 in a preferred embodiment, along with the corresponding appropriate sizing of the remaining components of the driver assembly 10, the driver assembly 10 of the present invention is able to fit within a conventional 4 inch junction box. Specifically, in many lighting and electrical applications, square 4 inch, or approximately four-inch, junction boxes are utilized as a mount point for traditional lighting. Accordingly, by ensuring that the driver assembly 10 of the present invention is dimensionally sized to fit within a 4 inch junction box, while as later described still being able to output in excess of 40 watts, the need for additional infrastructure and or exterior mounting structures can be eliminated, and a solid-state lighting system utilizing the driver assembly 10 of the present invention can easily replace a pre-existing light source.

Defined adjacent to the outer peripheral edge of the base element 20, and preferably adjacent to the hot edges 25, 25' of the base element 20, is a perimeter region 28. The perimeter region 28 is defined as an area of the base element 20 that is in generally close proximity to and extends inward from the one or more hot edges 25, 25'. In a preferred embodiment, the perimeter region may be substantially small and extend not more than half an inch from the hot edge 25, 25'. Naturally, however, it is understood that the perimeter region 28 can vary in dimensions depending upon the dimensions of the base element 20, and the mounting needs for the operative components that will be secured in the perimeter region 28. Furthermore, the perimeter region 28 need not extend completely along a hot edge 25, 25' but at a minimum preferably is defined as that area extending from a hot edge 25, 25' in a location wherein a primary heat generating component is secured.

Secured to the base element 20, and functional to effectively power and drive the LED light source, are a plurality of operative components. The operative components may be mounted to both the top surface 22 and the bottom surface 24 of the base element 20, and are structured to control current flow to the at least one LED being driven. With regard to the operative components, it is understood that a large variety of different operative components can be incorporated within a traditional solid-state driver assembly so as to effectively manage, store and/or otherwise control power as well as provide feedback and/or other functionality and requirements for a specific application. For example, the operative components may include, in addition to those discussed in the present application, resistors, general diodes, zener diodes, capacitors, bridges, fuses, transient voltage suppressors, and/or mosfets. For purposes of clarity, however, only certain of the operative components that are exemplary of the structure and function of the present invention and the illustrated embodiments are discussed. Further, in the preferred embodiment of the present invention, the plurality of operative components are structured to be operative at least 40 watts, but optimally can be configured to be operative at any wattage from 40 watts to 200 watts. In this regard, it is noted that this range of wattages is provided as exemplary of a preferred embodiment of the present invention and is not intended to be limiting, as wattages is in excess of 200 watts and possibly wattages less than 40 may also be used and functional within the scope of the present invention in its various embodiments. Moreover, as can be understood, the wattage level at which the operative components utilized in the driver assembly 10 of the present invention operate create a correlation to the amount of heat that is being generated by the plurality of operative components. Traditionally, the configuration of operative components to function in excess of 40 watts and especially at 100 or 200 watts within drivers that are not configured according to the teachings of the present invention has resulted in the generation of less than optimal amounts of heat which can potentially negatively impact the functioning of those same operative components, and especially heat sensitive components included therein. Conversely the present invention, through its various embodiments, is structured and configured such that despite the utilization of operative components in higher wattage environments of 40 to 200 watts, and possibly even more, the thermal and operational characteristics of the driver assembly 10 are such that optimal performance, even in a compact configuration, can be achieved.

Included among the operative components secured to the base element 20 are at least two primary heat generating components. Specifically, although it is understood that a number of the operative components utilized with the present invention may generate some heat, and in fact relatively large quantities of heat, at least two of those operative components, and preferably two that are at the high end of heat generation compared to the remaining operative components, will be identified as the primary heat generating components. Looking further to the illustrated embodiment of the present invention, three primary heat generating operative components 34, 36 and 38 are illustrated. In the illustrated embodiment of the present invention the primary heat generating operative components comprise a hot carrier diode 34, a MOSFET 36 and a diode bridge 38. Of course, however, it is understood that these are exemplary of the primary heat generating components that are within the scope of the present invention and the illustrated configuration.

Looking further to the illustrated embodiment, the primary heat generating operative components 34, 36, 38 are preferably disposed on the perimeter region 28 of the top surface 22 of the base element 20. Accordingly, the primary heat generating operative components 34, 36, 38 are positioned as far away as possible from a central region of the base element 20, and thereby a majority of the remaining operative components. Likewise, as viewed in the figures, the plurality of primary heat generating components 34, 36, 38 can be positioned along and in substantially close proximity to one hot edge 25, or spaced along both hot edges 25, 25'.

In order to optimize the heat dissipation of the primary heat generating components 34, 36, 38, it is preferred that those components be positioned in a vertical orientation. Specifically, in the vertical orientation a vertical surface 35 of the component that extends away from the base element 20, and in most embodiments is generally perpendicular to the top surface 22 of the base element 20, has a greater surface area than a horizontal surface 35' that confronts the top surface 22 of the base element 20. As such, during functioning of the driver assembly 10 a majority of the heat generated by the primary heat generating components will necessarily radiate from their corresponding vertical surfaces 35. It is recognized that although in the illustrated embodiment the vertical surface 35 and horizontal surface 35' of the hot carrier diode 34 are illustrated and discussed, this is intended to be merely an illustrative example, as all of the primary heat generating components 34, 36, 38 defined as part of the present invention are also preferably configured in a vertical orientation and include a corresponding vertical surface 35 and horizontal surface 35'.

In view of this vertical orienting of the primary heat generating components 34, 36, 38, a general height of the overall driver assembly 10 is impacted. Preferably, however, the maximum vertical dimension of the primary heat generating components 34, 36, 38 and/or any operative components secured to the base element 10 will be less than 1.5 inches, and in most cases substantially less than 1.5 inches so as to accommodate for the thickness of the base element, mounting posts, and heat sink 80, to be described, while still fitting within a 1.5 inch depth junction box.

As noted, the driver assembly 10 of the present invention further comprises a heat sink 80. The heat sink 80 is preferably formed from any of a variety of heat conductive and heat radiating materials which will promote the absorption of heat from the operative components disposed on the base element 20. By way of example only, an optimal material for the construction of the heat sink 80 may be a metal such as stainless steel or aluminum. Looking further to the heat sink 80, in a preferred illustrated embodiment, it preferably includes a planar elements 82, and at least one, but preferably two or more, vertical elements 84, 84' formed substantially of the thermally conductive material. In this regard, it is contemplated that in some embodiments one or both vertical elements 84, 84' alone may be included to define the heat sink without the planar element 82, those vertical elements 84, 84' being secured to the operative components and/or to a fixture or fixture component into which the heat will be directed. With regard to the preferred planar element 82 of the illustrated embodiment of the heat sink 80, it is preferably sized and configured to be disposed in generally confronting, heat receiving relation to the lower surface 24 of the base element 20. As such, while the planar element 82 may be only partially configured of the thermally conductive material and/or be sized to only partially confront the lower surface 24 of the base element 20, in the preferred illustrated embodiments the planar element 82 confronts the entire lower surface 24 of the base element 20 for maximum heat exchange. Moreover, as is seen from the figures, although the planar element could be positioned in direct contact with the base element 20, it is preferred that a degree of spacing from the base element 20, such as in a preferred range of 0.25 to 0.5 inches be maintained so as to provide sufficient room and spacing for some operative components to be entirely or partially secured to, or disposed on, the bottom surface 24 of the base element 20. Accordingly, it is preferred that heat be radiated from the operative elements to the planar element 82 as opposed to being directly conducted along a contacting surface. Although, it is recognized that a configuration wherein portions of the planar element 82 does contact operative components and/or the base element 20, so as to allow for conductive heat transfer, may also be possible.

In addition to the planar element 82, the heat sink 80 also preferably includes at least one vertical element 84, also preferably formed at least partially, but optimally in its entirety, of a thermally conductive material. As illustrated in the drawings, a preferred embodiment of the heat sink 80 includes two vertical elements 84, 84' to correspond the two hot edges 25, 25' of this embodiment, with each of the vertical elements 84, 84' having a generally unitary configuration. Nevertheless, it is understood that the vertical elements 84, 84' may include a series of panels and/or include a series of gaps and/or may take on a more three-dimensional configuration versus the generally flatter plate like configuration shown in the illustrated embodiment.

The vertical elements 84, 84' of the heat sink 80 are disposed and configured to extend upwardly from the planar element 82, preferably in a generally perpendicular direction. As such, when the heat sink 80 and base element 20 are operatively positioned relative to one another, the vertical elements 84, 84' pass along part of the outer peripheral edge of the base element 20. More precisely, the vertical elements 84, 84' preferably extend upward in generally adjacent relation past the hot edges 25, 25' of the base element 20, and thereby closest to the peripheral region 28 of the base element 20. Accordingly, the vertical elements 84, 84' are disposed in substantially close proximity to at least some of the primary heat generating components 34, 36, 38. As illustrated, the vertical elements 84, 84' are preferably sized and disposed to generally confront the vertical surfaces 35 of the primary heat generating components so as to be positioned in heat receiving relation thereto. Here again, the heat sink 80 and in particular the vertical elements 84, 84' may be in substantially direct contact with the vertical surface 35 of the primary heat generating components 34, 36, 38 so as to provide for conductive heat transfer into the heat sink 80, however, in many preferred embodiments at least some small spacing may be maintained so as to achieve radiated heat transfer along a majority of the confronting surfaces. Additionally, it is viewed that both the planar element 82 and the vertical elements 84, 84' may include a number of mount points to which either the base element 20 and/or individual operative components themselves may be secured as necessary.

In order to preserve the optimal dimensional characteristics of the driver assembly 10 it is also preferred that the vertical elements 84, 84' be less than 1.5 inches and the planar element 82 be less than 4 inches in any directional axis, so as to effectively fit within a 4 inch junction box. Nevertheless, it is recognized and contemplated within the scope of the present invention that different sized junction boxes, including deeper junction boxes that can accommodate more than 1.5 inches may also be utilized and may correspondingly allow for dimensional variations of the heat sink 80 and operative components. This maybe applicable to accommodate differences in both the depth of the junction box and/or containment structure in which the driver assembly 10 is ultimately mounted, as well as the axial dimensions of the junction box and/or containment structure in which the driver assembly 10 is to be mounted.

Figure 5:
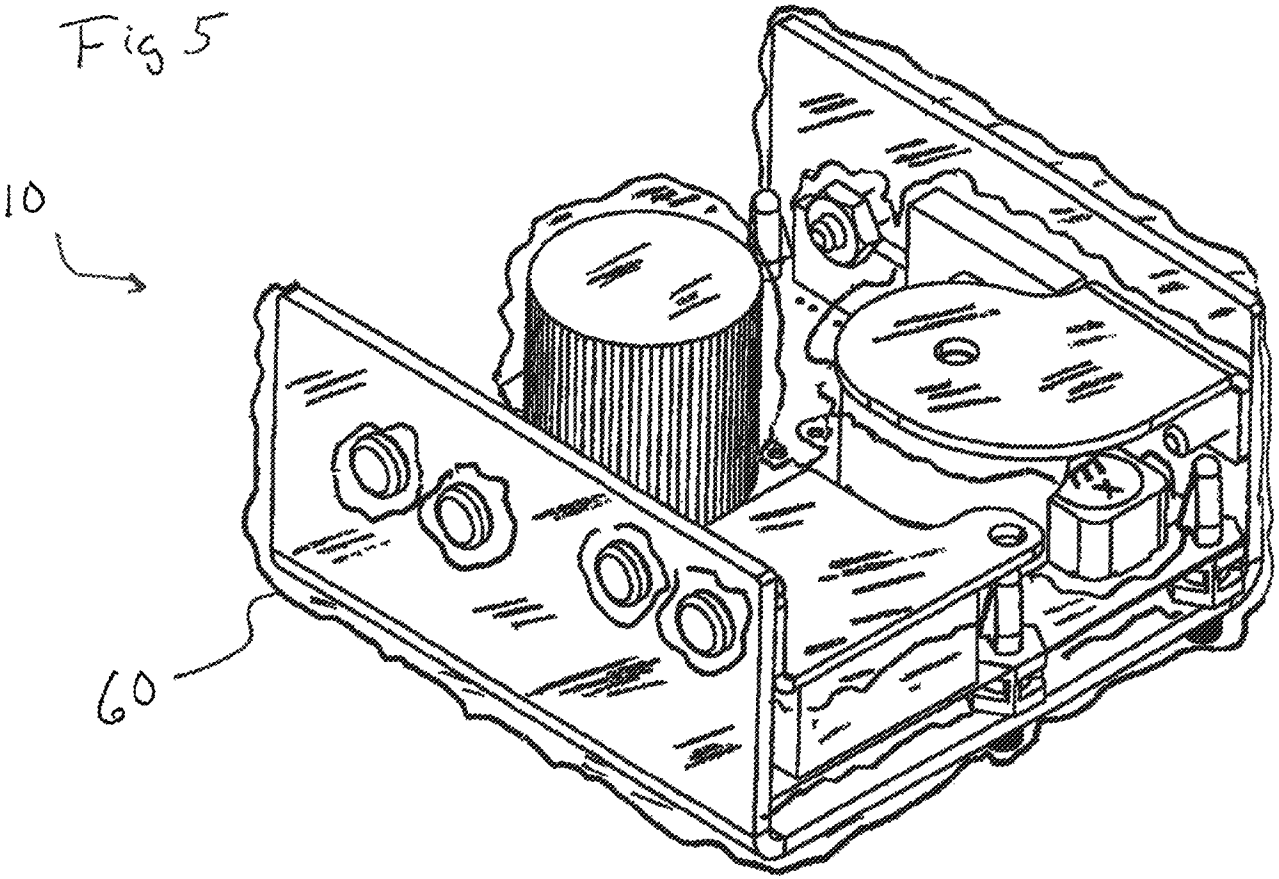
FIG. 5 is a perspective view of an embodiment of the present invention that includes the encapsulation layer.

Looking to the embodiment of FIG. 5, the driver assembly 10 of the present invention may also include an encapsulating layer 60. Specifically, because of the substantially compact configuration of the driver assembly 10 of the present invention, and in particular of the base element 20, the operative components, and the heat sink 80 which result from the effective placement, structure and positioning of the operative components and the heat sink pursuant to the present invention, substantially the entire driver assembly 10 may be effectively potted by the encapsulating layer 60. In particular, in order to effectively contain any possible source of ignition or flammability that may result during operation of the driver assembly 10, the encapsulation layer 60 is configured to substantially completely enclose and encase all of the operative components, the base element 20, and the heat sink 80. The encapsulation layer 60 preferably forms a conformance coating that conforms to the shape and configuration of the driver assembly 10, and can be formed from a variety of different potting materials including polyurethane, silicone, epoxy resin and/or other materials. The encapsulating layer 60 will be defined by pouring an acceptable potting material, while in its liquid state, over a fully assembled heat sink 80, base element 20 and operative components, and/or dipping into said material, and then allowing the encapsulation layer 60 to effectively dry and solidify. In this regard, it is understood that the encapsulation layer 60 will preferably not be a rigid or hard coating material, but rather when solidified will maintain a generally resilient and/or at least partially malleable configuration. Nevertheless, a more or completely rigid encapsulation layers 60 may also be utilized in certain applications. Further, by including the encapsulation layer 60, the operative components of the driver assembly 10 will not only be contained so that they do not provide a source of ignition or flammability within a potentially hazardous environment, and will thereby result in the driver assembly 10 be considered explosion proof, but will also serve to protect the operative components from liquid and moisture, such as may be prevalent in outdoor applications and/or in underwater or submerged applications. Indeed, because of the substantially compact yet effectively heat dissipating configuration of the driver assembly 10 of the present invention, truly effective potting by the encapsulation layer 60 can be achieved in a manner that is substantially more practical and less susceptible to defects than would be possible if potting of a large form factor driver assembly were to be contemplated or attempted.

In addition to the primary heat generating components, the operative components of the present invention also preferably include at least one heat sensitive component. In this regard, it is noted that there may be any number of heat generating components in addition to the primary heat generating components described herein. Likewise, there may be a plurality of heat sensitive components with varying degrees of sensitivity, and in fact a heat generating component, including a primary heat generating component, may also be heat sensitive, and visa versa. Similarly, there may also be certain operative components that may not factor into the heat considerations of the driver assembly 10. Turning to the illustrated embodiment, there is preferably at least one heat sensitive component, and that heat sensitive component is preferably secured to the base element 20 in generally spaced relation from the hot edges 25, 25' that are adjacent to the peripheral region 28 at which the primary heat generating components are disposed. Further, it is recognized that the one or more heat sensitive components may be disposed on either the top surface 22 or the bottom surface 24 of the base element 20 and can be positioned in a direct central region of the base element 20 so as to provide maximum spacing from the primary heat generating components, and/or for reasons of spacing and/or design architecture may be configured in other areas of the base element 20 so long as they are not disposed in the peripheral region 28. In this manner, the heat being generated by the primary heat generating components, which is optimally drawn towards the heat sink 80 due to the structure, placement and configuration of those components and the heat sink 80, will have a limited impact on the heat sensitive components disposed throughout the remainder of the base element 20. This optimal configuration of the present invention, will thereby minimize the potential for malfunction of the operative components of the driver assembly 10, and especially the malfunction of the heat sensitive component(s). Also, by optimally spacing the primary heat generating components, in some cases from one another along the same hot edge 25, 25', or as illustrated, by positioning them adjacent to opposite hot edges 25, 25', a high heat concentration area is not generated. In particular, when a number of primary heat generating components are positioned too close to one another, the cumulative impact of those components can be more difficult to dissipate. To further minimize such an effect and maximize the ability of the heat sink 80 and the vertical orientation and positioning of the components to eliminate heat, in some embodiments of the present invention, the primary heat generating components may be thermally balanced, such as in the manner taught by co-pending patent application Ser. No. 14/274,008, the contents of which are hereby incorporated by reference.

Although there may be a variety of different heat sensitive components, in one embodiment of the present driver assembly 10 the at least one heat sensitive component may comprise a microprocessor 40. In this regard, it is noted that there may be a number of alternate embodiments of the present driver assembly 10 wherein the heat sensitive component is not a microprocessor 40, and in fact no microprocessor 40 is included as an operative component; However, for illustrative purposes an embodiment wherein a microprocessor 40 is included is shown, with that microprocessor 40 also defining the at least one heat sensitive component.

Looking further to the embodiment of the driver assembly 10 which includes a microprocessor 40, it includes a microprocessor 40 that is configured to calibrate a power output of the operative components. Specifically, in a preferred embodiment of the present invention the various operative components that are utilized to define the present driver assembly 10 are preferably configured so as to be capable of achieving a power output range instead of merely a single or very concise power output. For example, in preferred embodiments, there may be a 40-80 watt power output range configuration and a 100-200 watt configuration. The microprocessor 40 of the present invention is thereby included, and is configured to calibrate those various operative components so as to define a precise customized power output as may be needed for a specific application. By way of example only, the operative components that are selected for utilization within the driver assembly 10 of the present invention, such as the inductors, may be rated to achieve operative power outputs from 40 W to 80 W or from 100 W to 200 W. In traditional driver configurations these and the remaining operative components must be precisely programmed and/or calibrated before being mounted to the PCB in order to meet the desired power output of the driver assembly being designed. Within the present invention, however, and more specifically within the driver assembly 10 wherein a microprocessor 40 is included, the operative components may be secured and disposed on the base element 20 in an operative configuration without having to be pre-configured to a particular predefined power outputs. Of course, it is understood that there will be some generally standard power output configuration that is defined to the operative components when first installed, however, the microprocessor 40 of the present invention is specifically configured to be able to modify the calibration of the operative components after they have been secured to the base element 20. Accordingly, this permits either a single or a very select few configurations of operative components to be designed, each particular configuration being functional not merely for a specific pre-preprogrammed power output, but rather being functional at a power output range as will be subsequently defined by the microprocessor 40. Accordingly, a large inventory of a select few product configurations can be maintained, while a substantially broad and varied range of power outputs can be customized and achieved to any particular configuration after completed assembly of the driver assembly 10.

Looking further to the microprocessor 40, it is preferably an 8-bit or larger programmable microprocessor. Further, as with most microprocessors 40, it is highly heat sensitive and is generally a very low voltage component, such as a three volt part. Because of the effective thermal management achieved within the driver assembly 10 of the present invention, however, it is possible to include this highly thermally sensitive component, namely a microprocessor 40, in a manner that maintains the operational integrity of the microprocessor 40. Furthermore, looking to the embodiment of FIG. 5 wherein the encapsulation layer 60 is positioned about the entire driver assembly 10, it is also preferred that the microprocessor 40 include one or more control elements 42 that extend from the microprocessor 40, and preferably through the encapsulation layer 60. Specifically, in most embodiments it is preferred that the microprocessor include at least one or more control elements 42, although it is understood that a microprocessor 40 that does not require physical control elements 42 could be utilized and/or designed in the future. The control elements 42 are configured to allow external access to the microprocessor 40 regardless of whether the driver assembly 10 has been potted by the encapsulation layer 60 or not. In this manner, a user is able to effectively calibrate the corresponding operative components to achieve the desired functionality for the driver assembly 10, and in the preferred embodiment, so as to achieve a precise customized power output. Furthermore, due to the beneficial inclusion of the microprocessor 40 in an operative state despite the thermal sensitivity thereof, effective calibration of the operative components can also be achieved in the field, at an installation site, and/or can be changed or modified subsequent to use and/or installation of the driver assembly 10, as may be needed.

Looking further to the operative components of the present invention, they may include an input inductor 53 and an output inductor 50. Specifically, the input inductor 53 is structured to receive the input voltage to be utilized by the driver assembly 10 to appropriately power the LED light source. Conversely, the output inductor 50 is structured to maintain and output the voltage that ultimately drives the LED light source. In the preferred embodiments, the input and output inductors 53, 50 are both secured to the base element 20 in relatively close proximity with one another. For example, it is preferred that the inductors 50, 53 be within at least 8 inches of one another, or as in the illustrated embodiment within 4 inches of one another so as to be contained on the preferred compact base element 20 that can be disposed within a 4 inch junction box.

Because of the relatively close proximity of the input inductor 53 and output inductor 30 that is possible based upon the structure and configuration of the present invention, and the magnetic aspects of the inductors, there may be a risk of magnetic cross coupling which would result in power still being available at the output inductor 50 even when the driver assembly 10 does not intend to power the LED. As such, in a preferred embodiment of the present invention, at least one, and preferably the output inductor 50 is magnetically shielded such that magnetic interference and more particularly magnetic cross coupling does not occur. Further, it is preferred that the output inductor 50 be fully magnetically shielded in order to ensure that all inbound and outbound magnetic interference is prevented. Specifically, the magnetic field generated by the output inductor 50 is contained by the shielding, and the magnetic field generated by the input inductor 53 is prevented from impacting the output inductor 50. Further, it is noted that the magnetic shielding is preferably disposed on the output inductor 50 as the output inductor generally will produce less heat during normal operation of the driver assembly 10.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A driver assembly for solid state lighting that includes at least one LED comprising:

a base element;

said base element including an upper surface and a lower surface, and an outer peripheral edge extending about a periphery thereof;

said base element further comprising a perimeter region adjacent to said outer peripheral edge;

a plurality of operative components secured to said base element, said plurality of operative components collectively operative at least 40 watts and structured to control current flow to the at least one LED;

said plurality of operative components comprising at least two primary heat generating components and at least one heat sensitive component;

said primary heat generating components disposed on said perimeter region of said base element and said at least one heat sensitive component disposed in spaced relation from said outer peripheral edge adjacent said peripheral region in which said primary heat generating components are disposed;

said primary heat generating components further disposed in a vertical orientation wherein a vertical surface that extends away from said base element has a greater surface area than a horizontal surface that confronts said base element;

a heat sink, said heat sink including at least one vertical element formed of a thermally conductive material; and said at least one vertical element extending along at least a portion of said outer peripheral edge of said base element in confronting, heat receiving relation to said vertical surface of at least some of said primary heat generating components.

2. A driver assembly as recited in claim 1 wherein said outer peripheral edge of said base element is less than 4 inches long in any directional axis.

3. A driver assembly as recited in claim 2 wherein a maximum vertical dimension of said operative components is less than 1.5 inches.

4. A driver assembly as recited in claim 1 wherein said base element, said operative components and said heat sink are structured to be contained within a 4 inch junction box.

5. A driver assembly as recited in claim 1 further comprising an encapsulation layer structured to pott said base element, said operative components and said heat sink and contain any source of ignition or flammability.

6. A driver assembly as recited in claim 5 wherein said encapsulation layer is fluid impervious and is further structured to prevent liquid from contacting said operative components.

7. A driver assembly as recited in claim 1 wherein said base element comprises a printed circuit board.

8. A driver assembly as recited in claim 1 wherein said outer peripheral edge comprising two pairs of substantially parallel opposing edges.

9. A driver assembly as recited in claim 8 wherein one of said pair of substantially parallel opposing edges comprise hot edges, said at least one vertical element of said heat sink disposed adjacent at least one of said hot edges.

10. A driver assembly as recited in claim 9 wherein said perimeter region further comprises at least two hot regions, each of said hot regions disposed adjacent said hot edges.

11. A driver assembly as recited in claim 10 wherein said primary heat generating components are disposed in said hot regions.

12. A driver assembly as recited in claim 11 wherein said heat sink comprises a pair of said vertical elements, said vertical elements disposed adjacent both of said hot edges so as to direct heat generated by said primary heat generating components towards said hot edges and away from said heat sensitive component.

13. A driver assembly as recited in claim 12 wherein at least one of said primary heat generating components comprises a hot carrier diode.

14. A driver assembly as recited in claim 12 wherein at least one of said primary heat generating components comprises a diode bridge.

15. A driver assembly as recited in claim 12 wherein at least one of said primary heat generating components comprises a MOSFET.

16. A driver assembly as recited in claim 12 wherein said heat sink further comprises a planar element, said planar element secured in confronting, heat receiving relation to said lower surface of said base element.

17. A driver assembly as recited in claim 1 wherein said operative components are structured to achieve a power output range and said heat sensitive component comprises at least a microprocessor, said microprocessor structured to calibrate a power output of said operative components within said power output range so as to achieve a precise customized power output.

18. A driver assembly as recited in claim 17 further comprising an encapsulation layer structured to pott said base element, said operative components and said heat sink and contain any source of ignition or flammability.

19. A driver assembly as recited in claim 18 wherein said microprocessor comprises at least one control element, said control element extending through said encapsulation layer and structured to provide exterior programming access to said microprocessor so as to define said power output of said operative components within said power output range, without requiring replacement of any of said operative components.

20. A driver assembly as recited in claim 17 wherein said plurality of operative components collectively operative at least 100 watts.

21. A driver assembly as recited in claim 17 wherein said plurality of operative components collectively operative at least 200 watts.

22. A driver assembly as recited in claim 1 wherein said operative components further comprise an input inductor and an output inductor, both of said inductors being disposed on said base element, and at least one of said inductors being magnetically shielded so as to prevent magnetic interference between said inductors.

23. A driver assembly as recited in claim 22 wherein said output inductor is fully magnetically shielded.

* * * * *